US007003829B2

(12) United States Patent
Choi et al.

(10) Patent No.: US 7,003,829 B2
(45) Date of Patent: Feb. 28, 2006

(54) STRETCHER WITH GEAR MECHANISM FOR ADJUSTABLE HEIGHT

(75) Inventors: Byung Ki Choi, Mapo-Gu, Shinjung-Dong, Seo-Gang LG A, 104-1101, Seoul (KR) 0276356-4607; Michael Min, San Francisco, CA (US)

(73) Assignee: Byung Ki Choi, Danville, CA (US)

( * ) Notice: Subject to any disclaimer, the term of this patent is extended or adjusted under 35 U.S.C. 154(b) by 0 days.

(21) Appl. No.: 10/899,676

(22) Filed: Jul. 26, 2004

(65) Prior Publication Data

US 2006/0016008 A1 Jan. 26, 2006

(51) Int. Cl.
*A61G 1/02* (2006.01)

(52) U.S. Cl. ..... 5/611; 5/86.1; 296/20

(58) Field of Classification Search ..... 5/611, 5/610, 86.1, 81.1 R, 11, 625, 627; 296/20; 280/43.16; 16/44, 45
See application file for complete search history.

(56) References Cited

U.S. PATENT DOCUMENTS

| | | | | | |
|---|---|---|---|---|---|
| 1,273,214 | A | * | 7/1918 | Gleason | 280/43.16 |
| 2,599,717 | A | | 6/1952 | Menzies | 5/510 |
| 2,985,891 | A | * | 5/1961 | Hutt | 5/11 |
| 3,304,116 | A | | 2/1967 | Stryker | 296/20 |
| 3,305,876 | A | * | 2/1967 | Hutt | 5/11 |
| 3,644,944 | A | | 2/1972 | Bourgraf et al. | 5/610 |
| 3,802,002 | A | * | 4/1974 | Jonas | 5/611 |
| 4,023,849 | A | * | 5/1977 | Bethlen | 296/20 |
| 4,097,941 | A | | 7/1978 | Merkel | 295/20 |
| 4,164,355 | A | | 8/1979 | Eaton et al. | 296/20 |
| 4,175,783 | A | | 11/1979 | Pioth | 296/20 |
| 4,319,381 | A | * | 3/1982 | Rodaway | 16/44 |
| 4,365,801 | A | * | 12/1982 | Medina et al. | 482/34 |
| 4,489,449 | A | | 12/1984 | Failor et al. | 5/83.1 |
| 4,579,381 | A | | 4/1986 | Williams | 296/20 |
| 4,584,989 | A | | 4/1986 | Stith | 600/18 |
| 4,667,354 | A | | 5/1987 | Carey, Jr. et al. | 5/614 |
| 4,669,136 | A | | 6/1987 | Waters et al. | 5/601 |
| 4,688,279 | A | | 8/1987 | Vance | 5/626 |
| 4,723,808 | A | | 2/1988 | Hines | 296/20 |
| 4,767,148 | A | | 8/1988 | Ferneau et al. | 296/20 |
| 4,771,785 | A | * | 9/1988 | Duer | 600/415 |
| 4,927,127 | A | * | 5/1990 | Lock | 5/611 |
| 4,987,623 | A | | 1/1991 | Stryker et al. | 5/86.1 |
| 5,048,133 | A | | 9/1991 | Iura et al. | 5/81.1 C |
| 5,069,465 | A | | 12/1991 | Stryker et al. | 280/47.371 |
| 5,165,141 | A | * | 11/1992 | Soltani | 16/44 |
| 5,172,442 | A | | 12/1992 | Bartley et al. | 5/611 |
| 5,375,277 | A | | 12/1994 | Carr et al. | 5/625 |
| 5,432,966 | A | | 7/1995 | Berta et al. | 5/611 |
| 5,435,027 | A | | 7/1995 | Bourgraf et al. | 5/611 |
| 5,509,159 | A | | 4/1996 | Du-Bois | 5/627 |
| 5,522,100 | A | | 6/1996 | Schilling et al. | 5/86.1 |
| 5,537,700 | A | | 7/1996 | Way et al. | 5/611 |
| 5,575,026 | A | | 11/1996 | Way et al. | 5/617 |
| 5,806,111 | A | | 9/1998 | Heimbrock et al. | 5/86.1 |

(Continued)

*Primary Examiner*—Robert G. Santos
(74) *Attorney, Agent, or Firm*—Hogan & Hartson, L.L.P.

(57) ABSTRACT

A stretcher comprises a patient support area supported by front legs and rear legs. The front legs and rear legs are coupled by a gear mechanism, and an actuation device coupled to the gear mechanism effects retraction or extension of the stretcher in a smooth and continuous motion. The actuation device is operable to lock the gear mechanism to position the stretcher at any desired height between fully extended and fully retracted.

7 Claims, 9 Drawing Sheets

U.S. PATENT DOCUMENTS

| | | | | |
|---|---|---|---|---|
| 5,913,559 | A | 6/1999 | Sexton et al. | 296/20 |
| 5,987,671 | A | 11/1999 | Heimbrock et al. | 5/600 |
| 5,996,149 | A | 12/1999 | Heimbrock et al. | 5/601 |
| 6,016,580 | A | 1/2000 | Heimbrock et al. | 5/86.1 |
| 6,125,485 | A | 10/2000 | Way et al. | 5/600 |
| 6,154,899 | A | 12/2000 | Brooke et al. | 5/81.1 R |
| 6,203,085 | B1 | 3/2001 | Ferris | 296/20 |
| 6,219,864 | B1 | 4/2001 | Ellis et al. | 5/600 |
| 6,240,579 | B1 | 6/2001 | Hanson et al. | 5/86.1 |
| 6,256,812 | B1 | 7/2001 | Bartow et al. | 5/86.1 |
| 6,276,010 | B1 | 8/2001 | Way et al. | 5/611 |
| 6,357,077 | B1 * | 3/2002 | Jones et al. | 16/44 |
| 6,389,623 | B1 | 5/2002 | Flynn et al. | 5/611 |
| 6,405,393 | B1 * | 6/2002 | Megown | 5/611 |
| 6,421,854 | B1 | 7/2002 | Heimbrock | 5/610 |
| 6,427,263 | B1 | 8/2002 | Lindell | 5/86.1 |
| 6,435,538 | B1 | 8/2002 | Ellis et al. | 280/650 |
| 6,499,163 | B1 | 12/2002 | Stensby | 5/618 |
| 6,505,359 | B1 | 1/2003 | Heimbrock et al. | 5/86.1 |
| 6,526,611 | B1 | 3/2003 | Flynn et al. | 5/611 |
| 6,598,247 | B1 | 7/2003 | Heimbrock et al. | 5/86.1 |
| 6,651,280 | B1 * | 11/2003 | Blevins | 5/611 |
| 2001/0044965 | A1 * | 11/2001 | Blevins | 5/611 |
| 2004/0107534 | A1 * | 6/2004 | Hsiao | 16/44 |

* cited by examiner

STRETCHER WITH GEAR MECHANISM FOR ADJUSTABLE HEIGHT

FIELD OF THE INVENTION

The present invention relates to a stretcher or mobile cot for transporting a patient and, in particular, relates to a stretcher having a novel lift and gear mechanism.

BACKGROUND OF THE INVENTION

Mobile stretchers or cots are used by paramedics or hospital personnel for transporting patients. The patient is typically kept on the mobile stretcher when loaded into an emergency vehicle. Hence, it is advantageous for stretchers to have an adjustable height so that they may be fit into the vehicle without removing the patient from the stretcher.

Stretchers having adjustable height mechanisms are known in the art, however, all suffer from various disadvantages. Typically, notched or slotted raising or lowering mechanisms are used that provide only fixed height points and thereby lack a wide range of extension and retraction. Moreover, height adjustment in this manner is typically an rough and jarring experience to the patient, and might possibly exacerbate the patient's condition. Known mechanisms for adjusting height also typically have a complex design with numerous parts, requiring an involved manufacturing process. The excess of parts also results in a heavier stretcher, which increases the burden and health risks on hospital and emergency personnel.

SUMMARY OF THE INVENTION

The present invention overcomes the disadvantages noted above. A novel apparatus and method for lifting (extending) and lowering (retracting) a mobile stretcher is provided. A novel gear mechanism is employed that smoothes and stabilizes ascent and descent of the stretcher, and provides the ability to lock the stretcher at any desired position between fully extended and fully retracted.

One embodiment of the invention is a stretcher comprising a patient support area supported by front legs and rear legs. The front legs and rear legs are coupled by a gear mechanism, and an actuation device coupled to the gear mechanism effects retraction or extension of the stretcher in a smooth and continuous motion. The actuation device is operable to lock the gear mechanism to position the stretcher at any desired height between fully extended and fully retracted.

Another embodiment of the invention is a height adjustment mechanism. The height adjustment mechanism comprises a gear mechanism mechanically coupling front and rear legs of the stretcher such that rotation of the front legs in a clockwise direction effects simultaneous rotation of the rear legs in a counter-clockwise direction, and vice-versa.

Other systems, methods, features and advantages of the invention will be or will become apparent to one with skill in the art upon examination of the following figures and detailed description. It is intended that all such additional systems, methods, features and advantages be included within this description, be within the scope of the invention, and be protected by the accompanying claims.

BRIEF DESCRIPTION OF THE DRAWINGS

The components in the figures are not necessarily to scale, emphasis instead being placed upon illustrating the principles of the invention. In the figures, like reference numerals designate corresponding parts throughout the different views.

DETAILED DESCRIPTION OF THE INVENTION

The present invention provides a novel apparatus and method for lifting (extending) and lowering (retracting) a mobile stretcher or cot. Several embodiments of the invention will be described. Common to all embodiments is the use of a novel gear mechanism that smoothes and stabilizes ascent and descent of the stretcher, and provides the ability to lock the stretcher at any desired position between fully extended and fully retracted.

First Embodiment—Configuration

Figure 1:
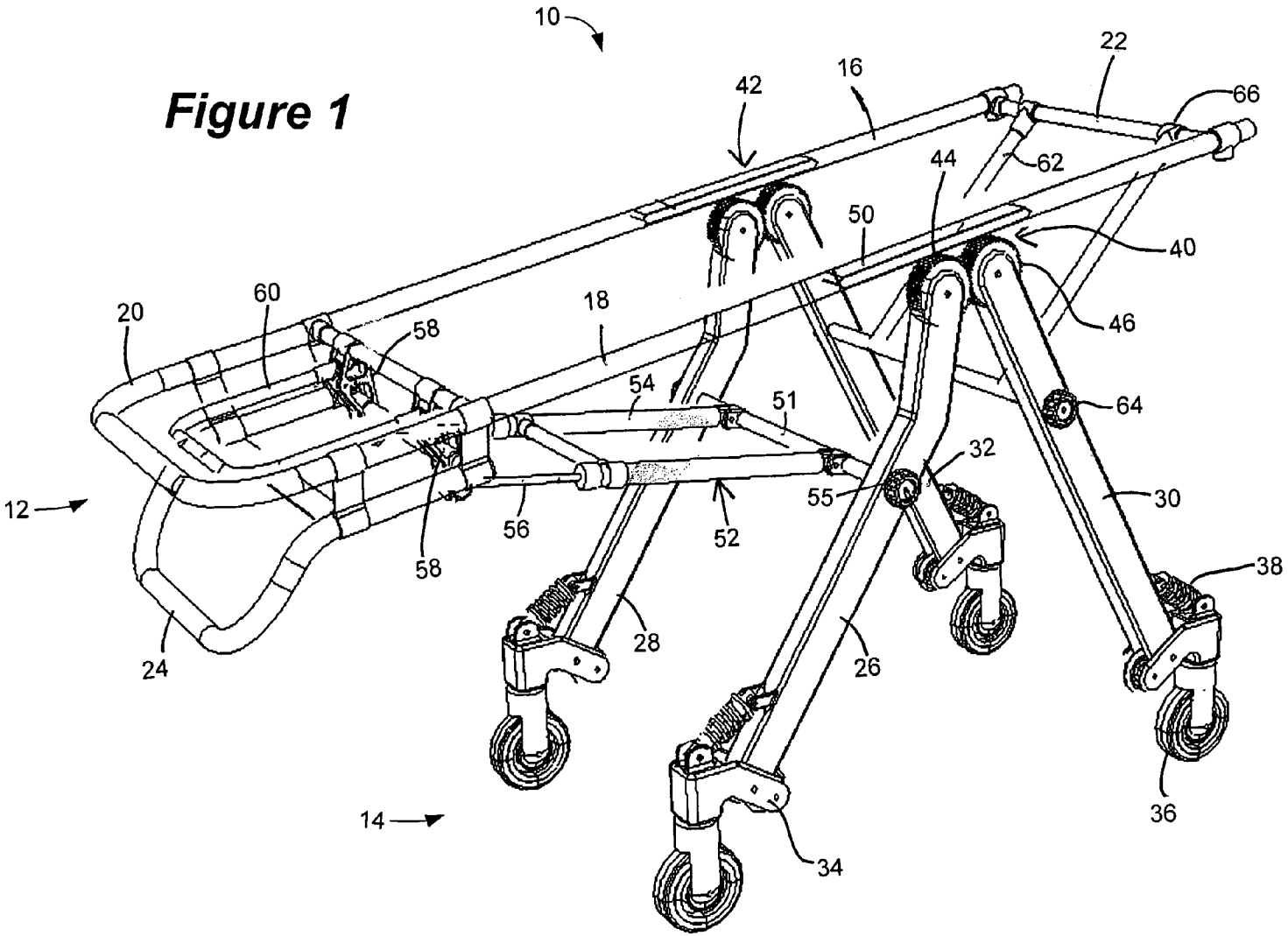
FIG. 1 is a perspective view of a first embodiment of a stretcher in a transfer and loading position according to the present invention.
Figure 2:
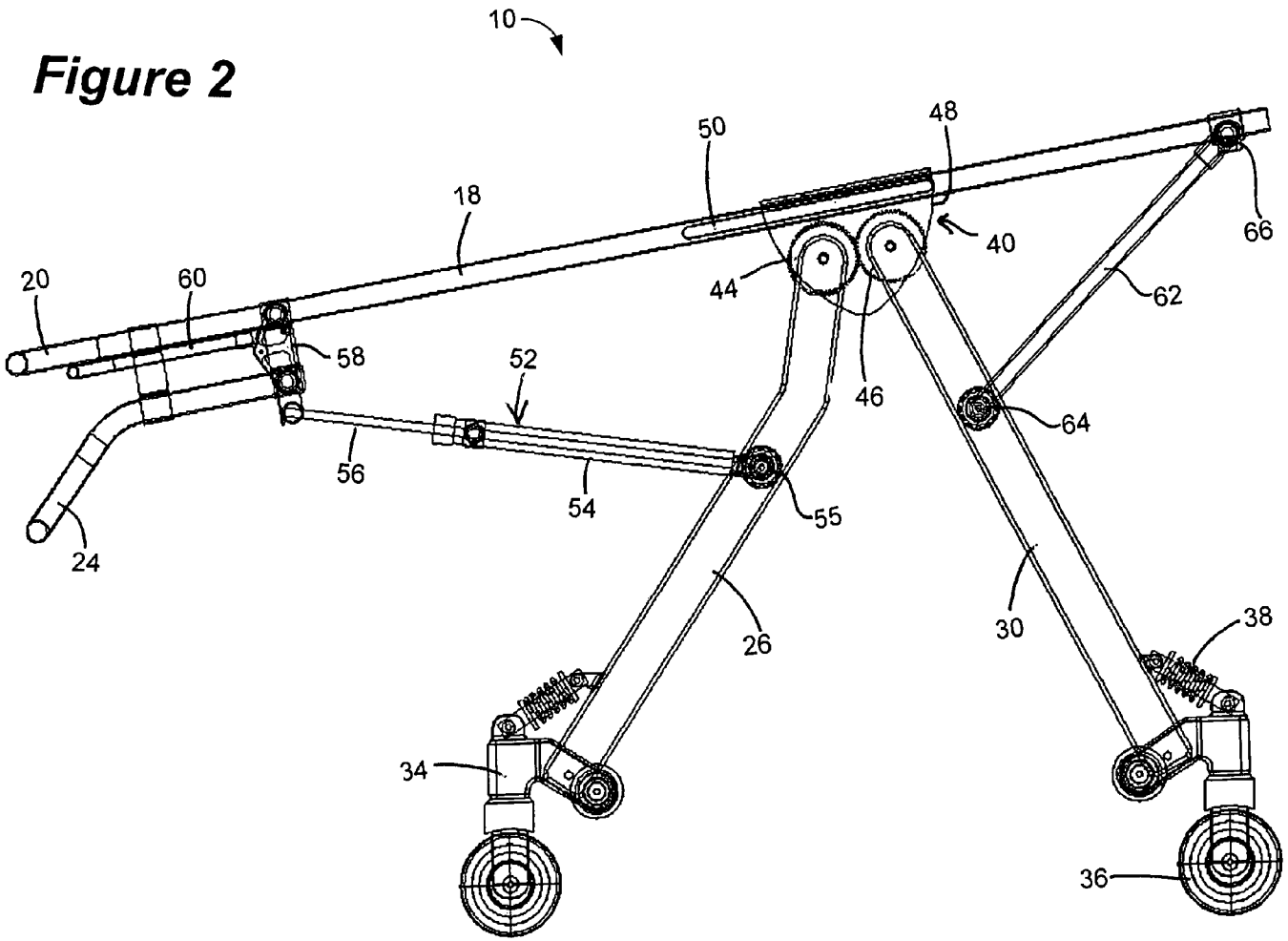
FIG. 2 is a side view of the stretcher of FIG. 1 in a transfer and loading position.

FIGS. 1 and 2 are perspective and side views of a first embodiment of a stretcher 10 in a transfer and loading position according to the present invention. Stretcher 10 comprises, generally, a patient support platform 12 supported by an adjustable undercarriage 14. Support platform 12 has a generally rectangular shape defined by side frame members 16 and 18. Side frame members 16 and 18 are coupled at the front end of stretcher 10 by upper pull handle 20 and at the rear end of stretcher 10 by rear frame member 22. Support platform 12 may also include a lower pull handle 24 mounted beneath upper pull handle 20.

Undercarriage 14 comprises front legs 26 and 28 and rear legs 30 and 32. The lower ends of the legs are hinged to wheel supports 34 which, in turn, are pivotally attached to wheels 36. Shock absorbing springs 38 are connected between the legs and wheel supports 34. The upper ends of front leg 26 and rear leg 30 are coupled by a gear mechanism 40, and the upper ends of front leg 28 and rear leg 32 are coupled by a gear mechanism 42. Gear mechanism 40, comprising a front gear wheel 44 coupled to a rear gear wheel 46, is mounted beneath side frame member 18 by a connecting housing 48 (FIG. 2). Connecting housing 48 is slidable along an internal track 50, enabling the gear mechanism and attached legs to shift right or left as undercarriage 14 is raised or lowered. Gear mechanism 42 is constructed and slidably mounted beneath side frame member 16 in identical fashion.

Front legs 26 and 28 are hinged to a gas spring 52 via a front leg cross member 51. Gas spring 52 comprises dual pressure tubes 54 and piston rods 56. In one embodiment, gas spring 52 is a combination gas and hydraulic spring. Rocking hinges 58 couple the piston rods 56 of gas spring 52 to an actuating handle 60 in a fashion that will be described in more detail below. Rear leg support member 62 couples rear legs 30 and 32 to rear frame member 22 and hinges about both lower hinges 64 and upper hinges 66.

First Embodiment—Retracting the Stretcher

Figure 3:
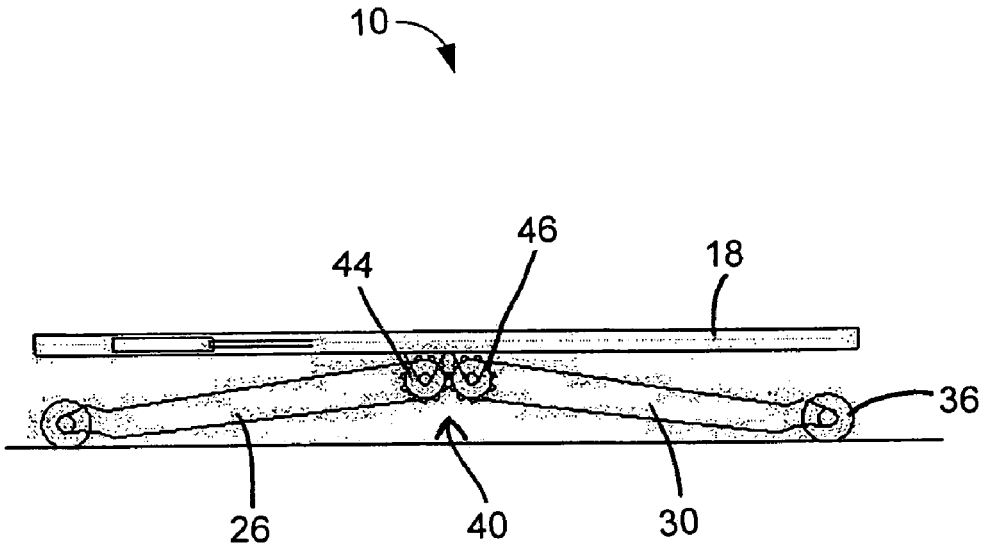
FIG. 3 is a side view of the stretcher of FIG. 1 in a folded position
Figure 4:
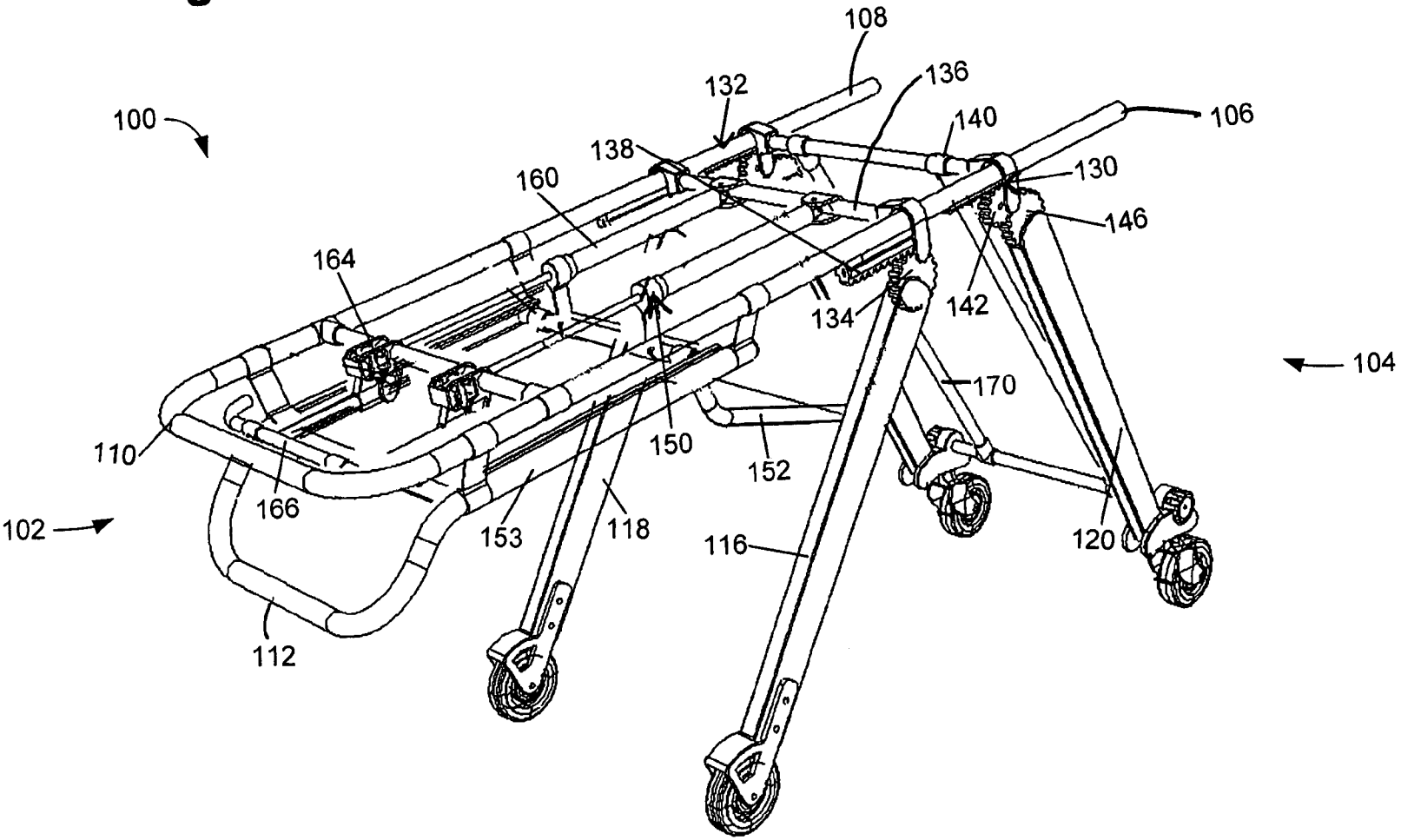
FIG. 4 is a perspective view of a second embodiment of a stretcher in a transfer and loading position according to the present invention.
Figure 5:
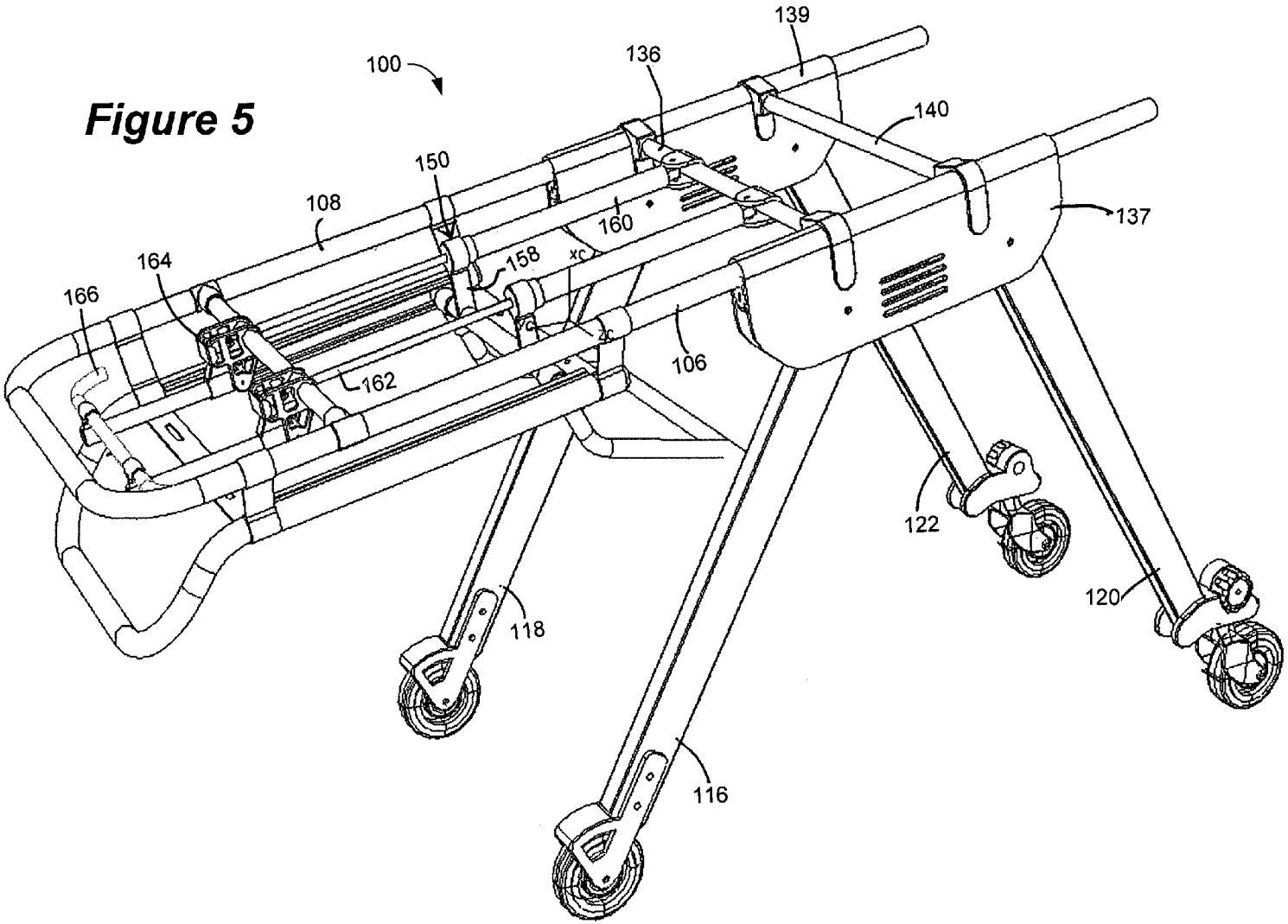
FIG. 5 is a perspective view of the stretcher of FIG. 1 showing housings enclosing the gear mechanisms.
Figure 6:
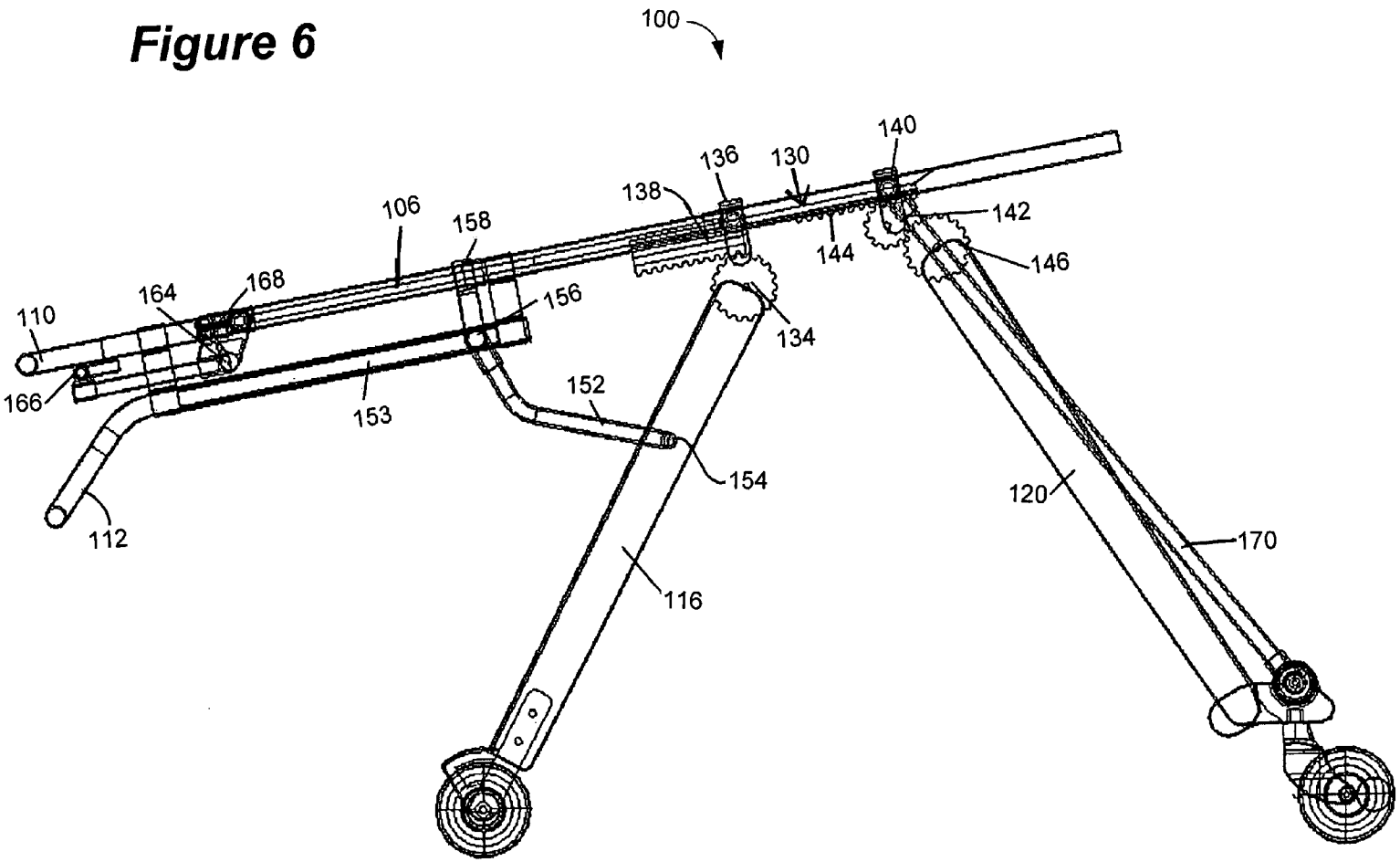
FIG. 6 is a side view of the stretcher of FIG. 4 in a transfer and loading position.
Figure 7:
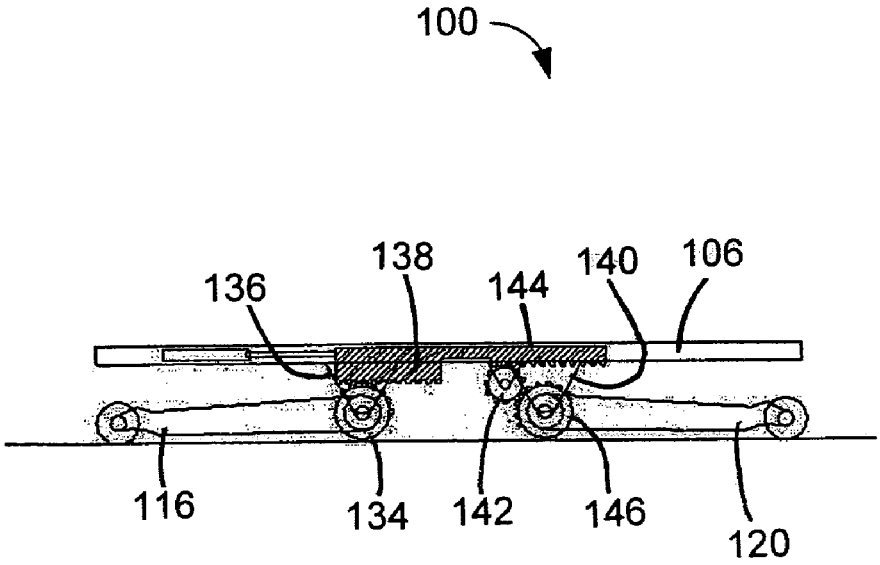
FIG. 7 is a side view of the stretcher of FIG. 4 in a folded position.

FIGS. 1 and 2 show stretcher 10 in a partially raised position. In order to collapse stretcher 10 to a lower or completely folded (FIG. 3) position, actuating handle 60 is engaged to actuate gas spring 52. Actuating handle 60, which is rotatable via its coupling to rocking hinges 58, is lifted or tilted up. Rocking hinges 58 contact release pins which, in turn, contact the heads of and unlock piston rods 56. The gas spring is then free to compress or expand. By default, gas spring 52 expands. When bearing the weight of support platform 12, however, gas spring 52 compresses. As will be described below, in order to raise the stretcher, the paramedic or other user lifts the stretcher using pull handles 20 and/or 24, removing the weight from gas spring 52 and allowing it to expand.

Compression of gas spring 52 pulls front legs 26 and 28 toward the front end of the stretcher via their hinged attachment to front leg cross member 51 and gas spring 52. That is, front legs 26 and 28 rotate in a clockwise direction about hinge point 55.

The front gear wheels of gear mechanisms 40 and 42, which are attached to the upper ends of front legs 26, 28, also rotate in a clockwise direction by virtue of the clockwise movement of the front legs. The teeth of the front gear wheels engage the teeth of the rear gear wheels, causing the rear gear wheels to rotate in a counter-clockwise direction. The counter-clockwise movement of the rear gear wheels, in turn, causes counter-clockwise movement of rear legs 30, 32 about hinge point 64. Rear legs 30, 32 are anchored, in turn, to patient support platform 12 via rear leg support member 62, which is anchored to rear frame member 22 and rotates about hinge point 66. This clockwise movement of the front legs and counter-clockwise movement of the rear legs results in retraction (lowering) of the stretcher, and continues so long as actuating handle 60 engages gas spring 52.

During retraction, as rear legs 30, 32 hinge up, rear leg support member 62 rotates in a clock wise position towards an orientation parallel to the ground plane. This movement causes the gear mechanisms to shift left, which they are free to do via the sliding of housing 48 along track 50.

At any point during retraction of stretcher 10, retraction may be halted and the stretcher locked into its currently position by releasing actuation handle 60. Gas spring 52 will be locked into its current position, preventing further clockwise movement of the front legs and, consequently, further rotation of the gear wheels and an effective locking of the gear mechanisms. In addition to the simple locking action provided by the combination of gas spring 52 and the gear mechanisms, it should also be noted that use of gas spring 52 absorbs shock while stretcher 10 is being raised or lowered, facilitating patient comfort. Additional ride comfort is provided by shock absorbing springs 38 between the stretcher legs and wheels.

While the invention is described with reference to a gas spring, it should be understood that other actuating apparatuses may be employed to actuate the gear mechanism and cause extension or retraction of the stretcher legs. For example, a slotted track system as is common in current stretchers, rather than a gas spring, could be used in conjunction with the gear mechanism. Such a configuration, however, would negate the smooth motion and locking operation described above and would also severely limit the variations in height positions.

First Embodiment—Extending the Stretcher

Stretcher 10 is raised or extended by reversing the retraction operation. First, the paramedic or user must lift the patient support platform 12 to remove its weight from gas spring 12. Actuating handle 60 is then lifted, unlocking and freeing the piston rods to move as described above. Without the weight of the patient support platform, gas spring 52 returns to its default mode of expansion. Expansion of gas spring 52 pushes front legs 26 and 28 toward the rear end of the stretcher via their hinged attachment to front leg cross member 51 and gas spring 52. That is, during expansion of gas spring 52, front legs 26 and 28 rotate in a counter-clockwise direction about hinge point 55.

The front gear wheels, consequently, rotate in a counter-clockwise direction, causing the rear gear wheels to rotate in a clockwise direction. The clockwise movement of the rear gear wheels, in turn, causes clockwise movement of rear legs 30, 32 about hinge point 64. Counter-clockwise rotation of the front legs and clockwise rotation of the rear legs results in lifting or raising of the stretcher, and continues so long as actuating handle 60 engages gas spring 52 and the weight of platform 12 is removed from spring 52. While stretcher 10 is being raised, rear leg support member 62 rotates in a counter-clock wise position towards an angular rotation relative to the ground plane, causing the gear mechanisms to shift back to the right via the sliding of housing 48 along track 50.

As with lowering stretcher 10, lifting may be halted at any time and the stretcher locked into its current position by releasing actuation handle 60. Gas spring 52 will be locked into its current position, preventing further rotation of the legs and gear wheels and an effective locking of the gear mechanisms. Again, gas spring 52 absorbs shock while stretcher 10 is being raised, facilitating patient comfort.

Second Embodiment—Configuration

A second embodiment 100 of a stretcher according to the present invention is depicted in FIGS. 4–9. The principle of operation of previously-described stretcher 10 is shared by stretcher 100: operation of a gas spring actuates a gear mechanism, causing the stretcher legs to extend or retract in a smooth, easily controllable and comfortable motion. While the principle of operation is the same, the mechanical configuration is slightly different. Accordingly, the description of stretcher 100 will focus on its differences relative to stretcher 10.

Like stretcher 10, stretcher 100 has a patient support platform 102 and an undercarriage 104. Support platform 102 includes side frame members 106 and 108, and front lift handles 110 and 112. Undercarriage 104 comprises front legs 116 and 118 and rear legs 120 and 122. Wheels are attached to the lower ends of the legs and, although not shown, shock absorbing springs may optionally be present between the wheels and the legs.

The upper ends of front leg 116 and rear leg 120 are coupled by a gear mechanism 130, and the upper ends of front leg 118 and rear leg 122 are coupled by a gear mechanism 132. Gear mechanism 130 comprises a front gear wheel 134 attached to a front gear bracket 136. Front gear bracket 136 is slidably mounted between side frame members 106 and 108, and extends from front gear wheel 134 to the corresponding front gear wheel at the top end of front leg 118. Gear rack 138 is mounted beneath side frame member 106 and engages front gear wheel 134. Gear rack 138 may also be formed with slots in its sides to facilitate the sliding motion of front gear bracket 136.

Gear mechanism 130 further comprises rear gear bracket 140 spaced from and attached to front gear bracket 136. Front and rear gear brackets 136 and 140 may be attached and fixed for relative movement by, for example, housings 137 and 139. Housings 137 and 139 also serve to enclose gear mechanisms 130 and 132. Rear gear bracket 140 is also slidably mounted between side frame members 106 and 108, and extends from upper rear gear wheel 142 below side frame member 106 to a corresponding upper rear gear wheel below side frame member 108. Gear rack 144 is mounted beneath side frame member 106 and engages upper rear gear wheel 142. Gear rack 144 may be integral with gear rack 138 (see, e.g., FIG. 7) or, alternatively, gear rack 144 and gear rack 138 may be separate pieces. The final part of gear mechanism 130 is a lower rear gear wheel 146 mounted to the top of rear leg 120 and engaging upper rear gear wheel 142. Gear mechanism 132, coupled between front leg 118 and rear leg 122, is configured in identical fashion. Front and rear gear brackets 136 and 140 are common to the two gear mechanisms.

Figure 8:
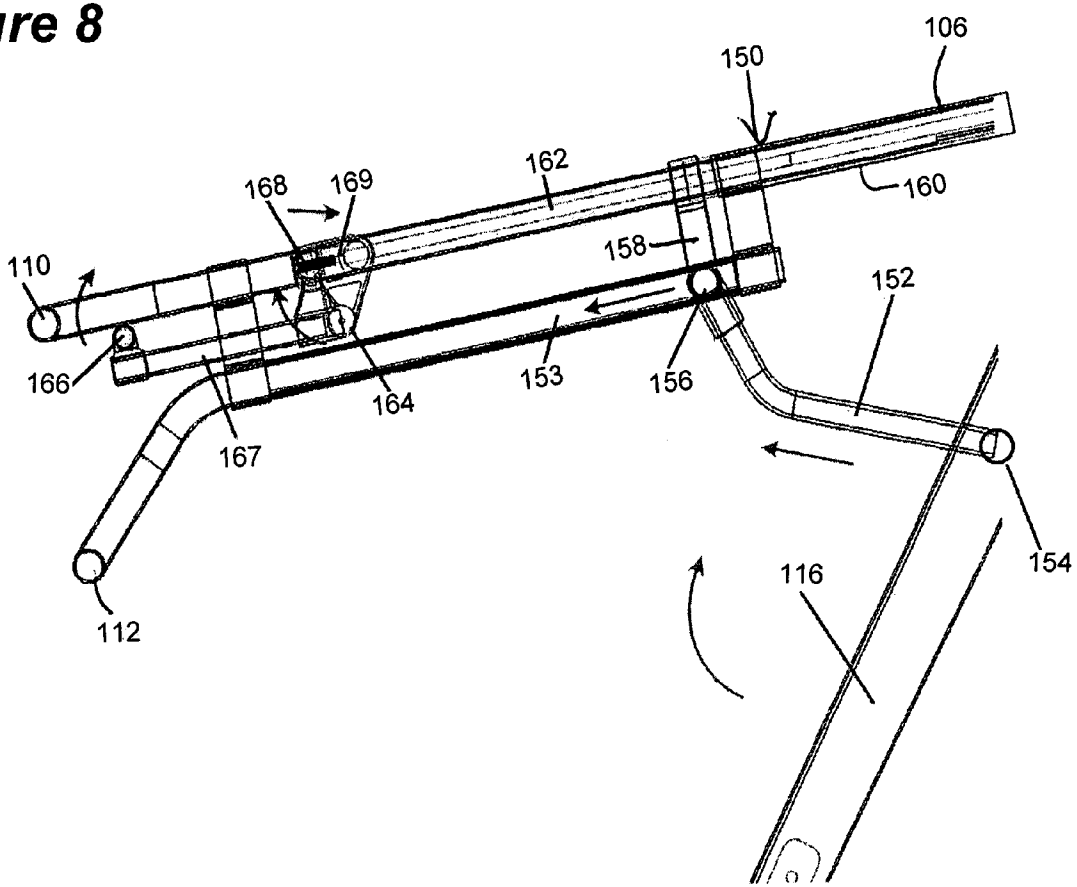
FIG. 8 is an exploded side view of the stretcher of FIG. 4 showing actuation of the gas spring.
Figure 9:
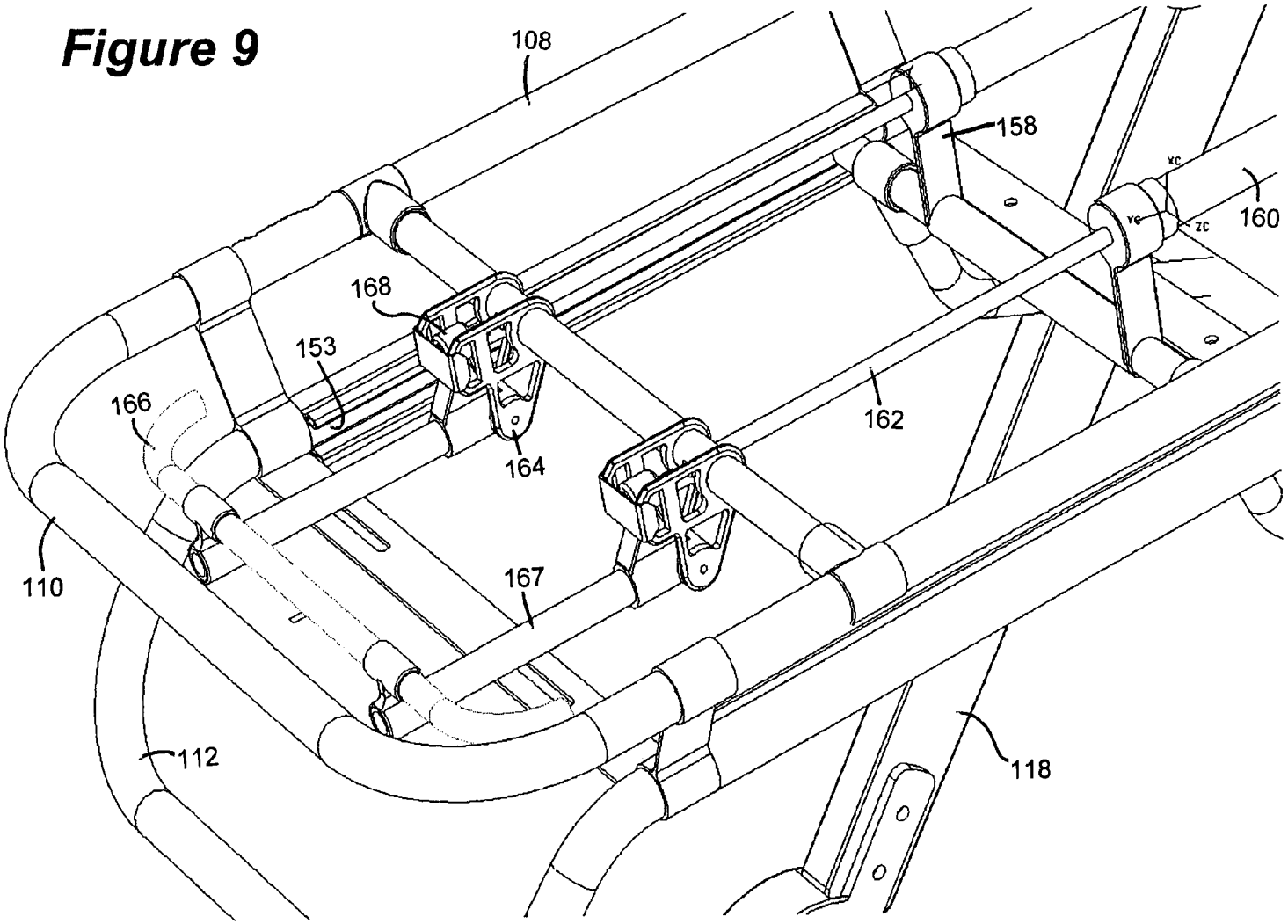
FIG. 9 is an exploded perspective view of the stretcher of FIG. 4 showing the rocking hinges and gas spring in greater detail.

The coupling of front legs 116 and 118 to gas spring 150 is best illustrated in the exploded view of FIG. 8. A leg arm 152 is attached at leg hinge 154 to the front legs, and at connector hinge 156 to a connector bracket 158 extending down from gas spring 150. Gas spring 150 comprises dual pressure tubes 160 and piston rods 162. Rocking hinges 164, as best depicted in FIGS. 8 and 9, couple piston rods 162 to an actuating handle 166, and include release pins 168 for unlocking piston rods 162 in response to movement of actuating handle 166. Front gear bracket 136 is coupled to the ends of pressure tubes 160 distal from piston rods 162, and rear gear bracket 140 is coupled to a helper bar 170 attached to the lower ends of rear legs 120 and 122.

Second Embodiment—Retracting the Stretcher

FIGS. 4–6, 8 and 9 show stretcher 100 in a partially raised position. In order to collapse stretcher 100 to a lower or completely folded (FIG. 7) position, actuating handle 166 is engaged to actuate gas spring 150. Actuating handle 166, which is rotatable via its attachment 167 to rocking hinges 164, is lifted or tilted up. Rocking hinges 164 contact release pins 168 which, in turn, contact the heads 169 of, and unlock piston rods 162 (FIG. 8). Gas spring 150 is then free to compress or expand. By default, gas spring 150 expands. When bearing the weight of support platform 102, however, gas spring 150 compresses. As will be described below, in order to raise the stretcher, the paramedic or other user lifts the stretcher using lift handles 110 and/or 112, removing the weight from gas spring 150 and allowing it to expand.

As best illustrated in FIG. 8, compression of gas spring 150 pulls front legs 116 and 118 toward the front end of the stretcher via the hinged attachments of legs arms 152 between front legs 116, 118 and gas spring 150. As the front legs are attached at their upper ends to upper gear bracket 136, this pulling motion results in the clockwise rotation of the front legs about leg hinges 154. As leg arms 152 are pulled, they slide within hinge tracks 153 via their connection to gas spring 152, which is compressing. Hinge tracks 153 are best illustrated in FIG. 9.

The front gear wheels (134) of gear mechanisms 130 and 132, which are attached to the upper ends of front legs 116 and 118, also rotate in a clockwise direction by virtue of the clockwise movement of the front legs. The teeth of the front gear wheels engage the teeth of gear track 138, causing the front gear bracket to shift left (towards the lift handles). As previously described, gear track 138 may be formed with slide slots to facilitate this shift.

Since rear gear bracket 140 is fixed for movement to front gear bracket 136 by housings 137 and 139 or other appropriate means, the leftward shift of front gear bracket 136 effects a corresponding and simultaneous leftward shift of rear gear bracket 140. Leftward movement of rear gear bracket 140 causes upper rear gear wheels 142 to rotate in a clockwise direction (via its engagement with gear rack 144). Clockwise rotation of the upper rear gear wheels, in turn, cause counter-clockwise rotation of lower rear gear wheels 146 and lower legs 120, 122 to which the lower rear gear wheels are attached. Rear legs 120, 122 are attached to hinged helper bar 170 (attached at its other end to rear gear bracket 140), which assists in counter-clockwise rotation of the rear legs. This clockwise movement of the front legs and counter-clockwise movement of the rear legs results in retraction (lowering) of the stretcher, and continues so long as actuating handle 166 engages gas spring 150.

At any point during retraction of stretcher 100, retraction may be halted and the stretcher locked into its current position by releasing actuation handle 166. Gas spring 150 will be locked into its current position, preventing further clockwise movement of the front legs and, consequently further rotation of the gear wheels and an effective locking of the gear mechanisms. In addition to the simple locking action provided by the combination of gas spring 150 and the gear mechanisms, it should also be noted that use of gas spring 150 absorbs shock while stretcher 100 is being raised or lowered, facilitating patient comfort. Additional ride comfort may be provided by optional shock absorbing springs between the stretcher legs and wheels.

Second Embodiment—Extending the Stretcher

Stretcher 100 is raised or extended by reversing the retraction operation. First, the paramedic or user must lift the patient support platform 102, using lift handles 110 and 112, to remove its weight from gas spring 150. Actuating handle 166 is then lifted, unlocking and freeing the piston rods to move as described above. Without the weight of the patient support platform, gas spring 150 returns to its default mode of expansion. Expansion of gas spring 150 pushes front legs 116 and 118 toward the rear end of the stretcher via its attachment to the front legs by hinged leg arms 152. That is, during expansion of gas spring 150, front legs 116 and 118 rotate in a counter-clockwise direction about leg hinge 154.

The front gear wheels, consequently, rotate in a counter-clockwise direction, causing upper gear bracket 136 to shift right. Correspondingly and simultaneously, rear gear bracket 140 shifts right, causing upper rear gear wheels to rotate in a counter-clockwise direction. This, in turn, causes the lower rear gear wheels and attached rear legs to rotate in a clockwise direction. Counter-clockwise rotation of the front legs and clockwise rotation of the rear legs results in lifting or raising of the stretcher, and continues so long as actuating handle 166 engages gas spring 150 and the weight of platform 102 is removed from spring 150.

As with lowering stretcher 100, lifting may be halted at any time and the stretcher locked into its current position by releasing actuation handle 166. Gas spring 150 will be locked into its current position, preventing further rotation of the legs and gear wheels and an effective locking of the gear mechanisms. Again, gas spring 150 absorbs shock while stretcher 100 is being raised, facilitating patient comfort.

Relative to other mechanisms and methods for lifting and lowering stretchers that are known in the art, the present invention is a simple, clean design that employs less parts, making manufacturing easier and resulting in a lighter stretcher. Use of a gas spring allows one to lock the stretcher at any desired height, and enhances patient comfort by absorbing shock during lifting or lowering. Known designs, conversely, generally use some form of slotted (fixed) height adjustment, which limits the range of extension and retraction and typically jars the patient during lifting and lowering.

While various embodiments of the invention have been described, it will be apparent to those of ordinary skill in the art that many more embodiments and implementations are possible that are within the scope of this invention.

What is claimed is:

1. A stretcher comprising:

a patient support area supported by front legs and rear legs; the front legs and rear legs being coupled by a gear mechanism comprising gear wheels mounted on upper ends of the front and rear legs, wherein teeth of the gear wheels mounted on the front legs engage teeth of the gear wheels mounted on the rear legs, so that rotation of the front legs and the gear wheels mounted thereon in one direction results in simultaneous rotation of the rear legs and the gear wheels mounted thereon in an opposite direction; and an actuation device coupled to the gear mechanism to effect retraction or extension of the stretcher in a smooth and continuous motion, the actuation device operable to lock the gear mechanism to position the stretcher at any desired height between fully extended and fully retracted.

2. A stretcher as claimed in claim 1, wherein the actuation device is a gas spring.

3. A stretcher as claimed in claim 2, wherein the actuation device further comprises an actuation handle configured to unlock a piston rod of the gas spring, thereby allowing expansion and compression of the gas spring.

4. A stretcher as claimed in claim 3, wherein the gas spring is coupled to the front legs so that compression of the gas spring effects retraction of the legs and expansion of the gas spring effects extension of the legs.

5. A stretcher as claimed in claim 1, and further comprising wheels mounted on the lower ends of the front and rear legs.

6. A stretcher as claimed in claim 5, and further comprising shock absorbing springs mounted between the wheels and the lower ends of the front and rear legs.

7. A stretcher comprising:

a patient support area supported by front legs and rear legs; the front legs and rear legs being coupled by a rear mechanism comprising gear wheels mounted on upper ends of the front and rear legs, wherein the gear wheels engage gear tracks mounted underneath the patient support area; and an actuation device coupled to the gear mechanism to effect retraction or extension of the stretcher in a smooth and continuous motion, the actuation device operable to lock the gear mechanism to position the stretcher at any desired height between fully extended and fully retracted.

* * * * *